US012595096B2

(12) United States Patent
Chen et al.

(10) Patent No.: US 12,595,096 B2
(45) Date of Patent: Apr. 7, 2026

(54) ONE-HANDED PRESS-OPEN COSMETIC CONTAINER

(71) Applicant: ZHEJIANG UKPACK PACKAGING CO., LTD., Yuyao City (CN)

(72) Inventors: Sen Chen, Yuyao City (CN); Shunjin Ji, Yuyao City (CN)

(73) Assignee: ZHEJIANG UKPACK PACKAGING CO., LTD, Yuyao (CN)

( * ) Notice: Subject to any disclaimer, the term of this patent is extended or adjusted under 35 U.S.C. 154(b) by 105 days.

(21) Appl. No.: 18/231,943

(22) Filed: Aug. 9, 2023

(65) Prior Publication Data

US 2024/0083639 A1 Mar. 14, 2024

(30) Foreign Application Priority Data

Sep. 8, 2022 (CN) ..... 202211097338.4
Feb. 21, 2023 (CN) ..... 202310160405.0

(51) Int. Cl.

| | |
|---|---|
| ***B65D 45/16*** | (2006.01) |
| ***A45D 33/00*** | (2006.01) |
| ***A45D 40/00*** | (2006.01) |
| ***B65D 45/28*** | (2006.01) |
| ***B65D 53/02*** | (2006.01) |
| *B65D 1/02* | (2006.01) |
| *B65D 51/24* | (2006.01) |

(52) U.S. Cl.

CPC ..... *B65D 45/16* (2013.01); *A45D 33/00* (2013.01); *A45D 40/0068* (2013.01); *B65D 45/28* (2013.01); *B65D 53/02* (2013.01); *B65D 1/023* (2013.01); *B65D 51/245* (2013.01); *B65D 2203/00* (2013.01)

(58) Field of Classification Search

CPC ..... B65D 45/28; B65D 45/16; A45D 40/0068
See application file for complete search history.

(56) References Cited

U.S. PATENT DOCUMENTS

| | | | | |
|---|---|---|---|---|
| 5,209,362 | A * | 5/1993 | Lutzker | B65D 51/20 220/729 |
| 5,960,972 | A * | 10/1999 | Larguia, Sr. | B65D 50/041 215/322 |
| 10,154,718 | B2 * | 12/2018 | Salciarini | B65D 45/16 |
| 10,470,550 | B2 * | 11/2019 | Salciarini | A45D 40/0068 |
| 2011/0000872 | A1 * | 1/2011 | Aneas | B65D 45/322 215/273 |

(Continued)

FOREIGN PATENT DOCUMENTS

| | | | |
|---|---|---|---|
| CN | 201268462 | Y | 7/2009 |
| CN | 102490979 | A | 6/2012 |
| CN | 110811110 | A | 2/2020 |

*Primary Examiner* — Don M Anderson
*Assistant Examiner* — Jennifer Castriotta
(74) *Attorney, Agent, or Firm* — OLIFF PLC

(57) ABSTRACT

A one-handed press-open cosmetic container includes a bottle body assembly and a bottle cap assembly. The bottle cap assembly includes a claw assembly that includes (i) a plurality of clasps and (ii) a button column protruding upward from a top of the claw assembly. The clasps engage with a snap-fit groove of the bottle body assembly. The claw assembly is configured to, upon receiving a downward force from a user's finger via the button column, deform the clasps outward to detach from the snap-fit groove of the bottle body.

12 Claims, 4 Drawing Sheets

(56) References Cited

U.S. PATENT DOCUMENTS

| | | | | |
|---|---|---|---|---|
| 2014/0103043 | A1* | 4/2014 | Lonsway | B65D 41/02 220/255 |
| 2017/0127797 | A1* | 5/2017 | Salciarini | A45D 40/222 |
| 2024/0051719 | A1* | 2/2024 | Cavusoglu Ataman | A61J 1/1412 |

* cited by examiner

ONE-HANDED PRESS-OPEN COSMETIC CONTAINER

TECHNICAL FIELD

The present invention relates to caps of the containers intended for cosmetics (e.g.: creams), and is a one-handed press-open cosmetic container.

BACKGROUND OF ART

Cosmetic containers mainly refer to containers intended for creams, lotions, perfumes and other cosmetic bottles, some of which are used for creams, face creams and other highly sealed viscous cosmetic containers. For example, a cream jar is a kind of bottle used for storing moisturizing cream. The body and cap of such bottles are usually fabricated from plastic material and categorized as double-layer bottles and single-layer bottles depending on the body structure. Such cosmetic containers are usually opened by rotating or pressing the cap such that the cream stored in the bottle or flowing out of the inner cap can be dipped by finger. See, for example, Chinese Patent Application No. 201911051594.8, Application Publication Date: 21 Feb. 2020, Title of Patent: "An all-plastic vacuum cream bottle in simple structure". As another example, see Chinese Patent Application No. ZL200820164066.4, Application Publication Date: 8 Jul. 2009, Title of Utility Model: "A press-open cream bottle".

The caps of other like products can be opened by pressing the button of the opening sleeve on the inner cap. See, for example, Chinese Patent Application No. 201110432098.4, Application Publication Date: 13 Jun. 2012, Title of Patent: "A press-open bottle cap". However, the caps of the above-mentioned products and like products can be categorized to a sort of anti-theft opening structure design. To be specific, these caps have to be pre-opened by rotating before use, then pressed to open, which is unfriendly to cap opening. The complicated structure design makes the height of the bottle cap assembly greater, resulting in inconvenient production and assembly, and poorer integrity and stability.

SUMMARY OF INVENTION

To overcome the above-mentioned deficiencies, the object of the present invention is to deliver a one-handed press-open cosmetic container for this technical field, to the extent that it can address the following technical concerns of the existing similar products: inconvenience of use, poor experience, inaccessibility to produce and assemble, poor integrity and stability and in particular, the flawed design of the snap-fit structure, and the snap-fit structure rarely uses the plastic resilience and the leverage principle. These objects are attained by the following technical solution.

A one-handed press-open cosmetic container comprises a bottle body assembly and a bottle cap assembly. The bottle body assembly is provided with humped snap ring at the outer diameter of the bottle neck at the bottle body, a snap-fit groove is provided at the outer diameter of the bottle neck underneath the snap ring, and the bottle cap assembly is fixed to the snap-fit groove of the bottle neck at the bottle body by a clasp of a claw assembly in the bottle cap assembly. The bottle cap assembly comprises an outer cap, a claw assembly and an inner cap, and clasps of the claw assembly are equally spaced and appear as L-shaped, disposed down inwardly, and the ends of the clasps are provided with inwardly humped heads. The clasps of the claw assembly are respectively snapped into the clasp holes at the top corners of the inner cap, and the clasps of the claw assembly are snapped into the clasp holes of the inner cap and securely snap-fit to the snap-fit groove of the bottle neck at the bottle body through a clasp head on one end of each clasp. The top of the claw assembly is provided with a resilient disc surface that is driven by pressing on top to deform the clasp and expand outwardly and detach from the snap-fit groove of the bottle neck at the bottle body, the top center of the resilient disc surface of the claw assembly is provided with an upwardly humped button column, the button column extends from or is disposed in the center hole of the top of the outer cap, and the inner cap with the claw assembly is snapped into the outer cap and the outer cap is engaged with the inner cap as one piece. To open the bottle cap assembly, when the claw assembly in the bottle cap assembly is pressed, the clasp of the claw assembly is deformed, driving the clasps to expand outwardly. The clasps are readily detached from the snap ring of the bottle body, and the bottle cap assembly is opened. This mode of cap opening leverages the linkage and resilience of the entire claw structure. The bottle cap assembly is opened for ease of use of cream. Now referring to the following structures, a scoop can be either disposed in the groove on top of the inner cap, or in the bottom storage groove at the bottle body of the bottle body assembly.

According to the characteristics of the above structure, a magnet can be disposed on the bottom of the groove of the inner cap, the bottom of the claw assembly on top of the bottle body of the bottle body assembly is provided with an iron scoop, and the iron scoop is securely attached to the magnet inside the inner cap.

A metal spring is disposed inside the groove of the inner cap which further stabilizes and boosts the elastic deformation and resilience of the claw assembly.

Each clasp of the claw assembly is provided with a curved humped inner rib at a joint between the clasp and the top of the claw assembly. The inner cap includes a plurality of curved corners near upper ends of the clasp holes, the curved corners being positioned to respectively receive the curved humped inner ribs of the clasps. The above structure makes it convenient for the clasps of the claw assembly to expand outwardly based on the leverage principle through the curved structure at the inner ribs of the claw assembly when a force is applied, which further boosts the resilience property of the claw assembly.

The clasps of the claw assembly are arranged symmetrically in six equally spaced pairs, and are engaged with the button column as one piece. An embodiment of the specific structure of the claw assembly is described above, where the clasps of the six snap-fit structures have better stability.

The top of the claw assembly is provided with an annular groove that surrounds the button column. The structure further boosts the linkage and resilience of the entire claw structure.

The top of the inner cap is provided with a downwardly humped groove. The bottle body assembly is provided with a sealing washer above the bottle neck at the bottle body of the bottle body assembly, the groove of the inner cap is snapped into a center hole of the sealing washer, and the button column is disposed above the groove of the inner cap. The structure facilitates the sealing between the sealing washer and the bottle body, the inner cap is engaged with the sealing washer as one piece and when opened, the bottle cap assembly is slightly popped upwards under the counteracting force of the sealing washer, which makes it convenient to remove the bottle cap assembly.

The button column of the claw assembly is a button snapped into the center of the of the claw assembly, with the button extending out of or disposed in the center hole on top of the outer cap. An embodiment of the combination structure of the claw assembly and the button is described above.

The top of the button column or the button of the claw assembly is provided with a mark, and the button column or the button of the claw assembly is round, polygonal, oval, star, heart-shaped, or has an irregular shape. The structure makes it convenient to mark the product and modify the shape.

The top of the outer cap omits the central hole, and the top of the button column of the claw assembly is abutted against the top inside the outer cap. When a force is applied on top, the outer cap will transmit the force to the top of the claw assembly. This forces the claw assembly to deform the clasps to expand outwardly and detach from the snap-fit groove of the bottle neck at the bottle body. An embodiment of the structure concealing the button column in the outer cap is described above, or alternatively, the button column of the outer cap can be omitted. It is enough to deform the claw assembly in the outer cap by pressing the top of the outer cap.

The structure of the present invention is simple and reasonable, and is easy to assemble, produce and open. In particular, the bottle cap has better stability and integrity. It can be suitably used as a one-handed press-open cosmetic container, as well as for the modified structure of like products.

Figure 1:
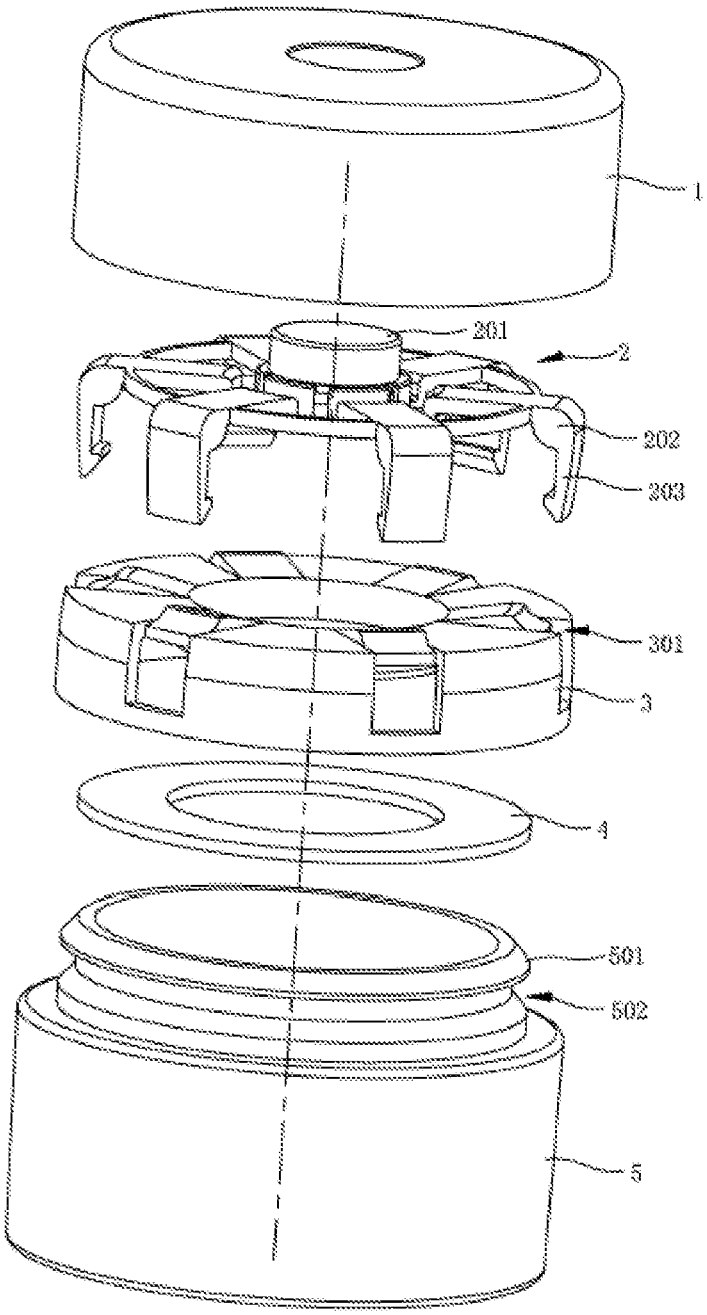
FIG. 1 is a schematic diagram of the exploded structure of the first embodiment of the present invention.

The reference numerals and names of elements in the accompanying drawings: 1. Outer cap, 101. Reinforcing rib, 2. Claw assembly, 201. Button column. 202. Inner rib, 203. Clasp, 204. Annular groove, 3. Inner cap, 301. Clasp hole, 302. Groove, 4. Sealing washer, 5. Bottle body assembly, 501. Snap ring, 502. Snap-fit groove, 6. Button, 7. Magnet, 8. Iron scoop, 9. Metal spring.

EMBODIMENTS

Figure 2:
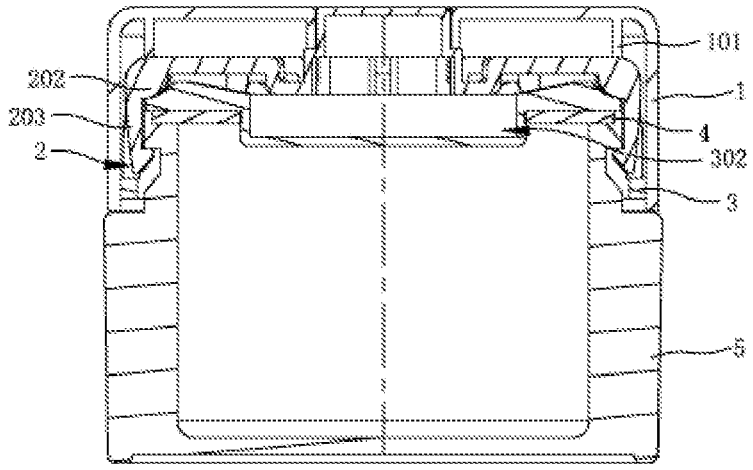
FIG. 2 is a schematic diagram of the cross-sectional structure in the initial state of FIG. 1.
Figure 3:
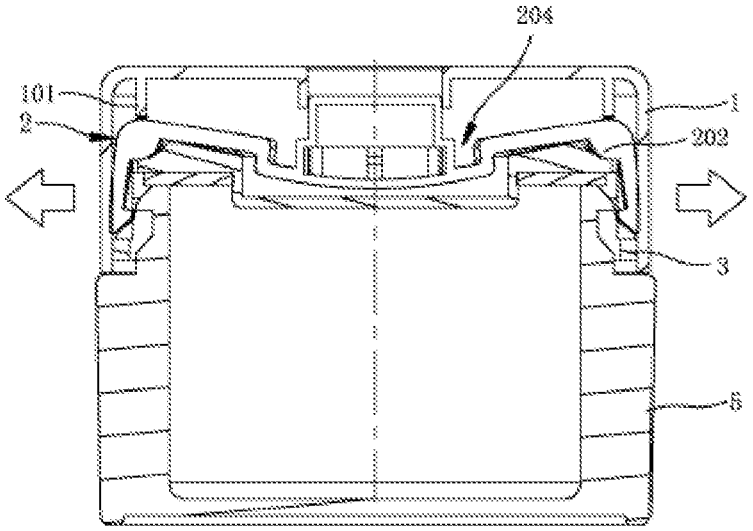
FIG. 3 is a schematic diagram of the cross-sectional structure as opened of FIG. 2.

Now referring to the accompanying drawings, the structure and use of the present invention are further described. With respect to Embodiment 1 as referred to in FIGS. 1-3, a one-handed press-open cosmetic container comprises a bottle body assembly 5 and a bottle cap assembly. The bottle body assembly is provided with a humped snap ring 501 at the outer diameter of the bottle neck at the bottle body, a snap-fit groove 502 is provided at the outer diameter of the bottle neck underneath the snap ring, and the bottle cap assembly is fixed to the snap-fit groove of the bottle neck at the bottle body by a clasp 203 of the claw assembly in the bottle cap assembly The bottle cap assembly comprises an outer cap 1, a claw assembly 2 and an inner cap 3, and the clasps 203 of the claw assembly are equally spaced and appear as L-shaped, disposed down inwardly, and the ends of the clasps are provided with inwardly humped heads. The clasps 203 of the claw assembly 2 are respectively snapped into the clasp holes 301 at the top corners of the inner cap 3, and the clasps of the claw assembly 2 are snapped into the clasp holes 301 of the inner cap 3 and securely snap-fit to the snap-fit groove 502 of the bottle neck at the bottle body through a clasp head on one end of each clasp 203. The top of the claw assembly is provided with a resilient disc surface that is driven by pressing on top to deform the clasps 203 to expand outwardly and detach from the snap-fit groove 502 of the bottle neck at the bottle body. The top center of the resilient disc surface of the claw assembly 2 is provided with an upwardly humped button column 201. The button column 201 extends from or is disposed in a center hole of the top of the outer cap, and the inner cap 3 with the claw assembly 2 is snapped into the outer cap 1 and the outer cap 1 is engaged with the inner cap 3 as one piece.

The particular structure of the inner cap and claw assembly 2 is described as follows: each clasp 203 of the claw assembly 2 is provided with a curved humped inner rib 202 at the joint with the resilient disc surface. The button column 201, inner ribs 202 and clasps 203 of the claw assembly 2 are molded in one piece. The inner ribs 202 of the claw assembly 2 are respectively abutted against the top outer end corners of the clasp holes 301 of the inner cap 3. Curved corners of the inner cap 3 receive the inner ribs 202, and a top reinforcing rib 101 in the outer cap is abutted against the top end corner of the claw assembly at the inner ribs 202 of the claw assembly 2. The clasps 203 of the claw assembly 2 are arranged symmetrically in six equally spaced pairs. The L-shaped clasps 203 and the inner ribs 202 are engaged with the button column 201 as one piece. An annular groove 204 in the top of the claw assembly 2 surrounds the button column 201. The top of the inner cap 3 is provided with a downwardly humped groove 302. The bottle body assembly is provided with a sealing washer 4 above the bottle neck at the bottle body of the bottle body assembly, the groove 302 of the inner cap 3 is snapped into a center hole of the sealing washer 4, and the bottom of the resilient disc surface of the claw assembly 2 is disposed above the groove 302 of the inner cap 3.

Figure 4:
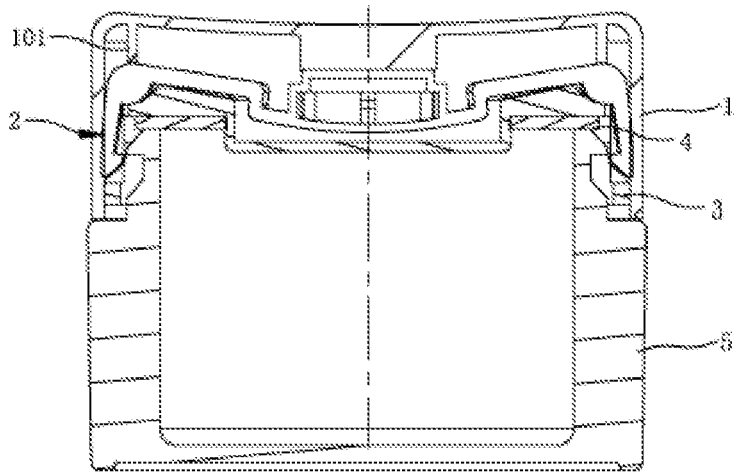
FIG. 4 is a schematic diagram of the modified cross-sectional structure as opened of FIG. 3.
Figure 5:
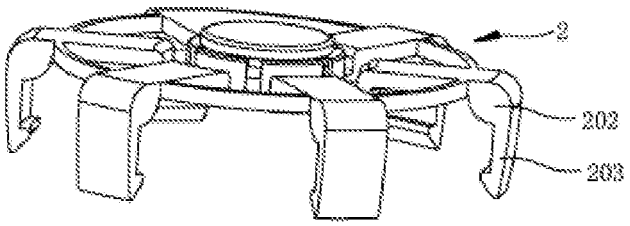
FIG. 5 is a schematic diagram of the claw assembly structure of FIG. 4.
Figure 6:
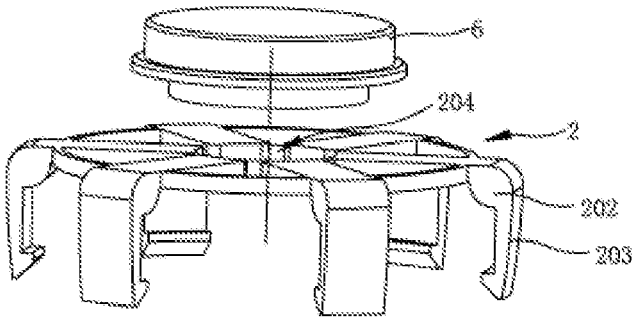
FIG. 6 is a schematic diagram of the modified claw assembly structure of FIG. 1.

As referred to in FIGS. 4 and 5, the top of the outer cap 1 omits the central hole, the top of the button column of the claw assembly 2 is abutted against the top inside the outer cap 1, and when a force is applied on top of the outer cap 1, the outer cap 1 will transmit the force to the top of the claw assembly 2, whereby the claw assembly 2 is forced to deform the clasps 203 to expand outwardly and detach from the snap-fit groove of the bottle neck at the bottle body. As referred to in FIG. 6, the button column of the claw assembly 2 is a button 6 snapped into the center of the resilient disc surface on top of the claw assembly, with the button extending out or disposed in a center hole in the top of the outer cap 1.

When the button column of the claw assembly 2 if pressed by the outer cap 1, as contained by the reinforcing rib of outer cap 1 and the clasp holes 301 of the inner cap 3, the claw assembly 2 will rotate about the centers of the inner ribs 202 based on the leverage principle, and the vertical movement of the clasps 203 at the button column will be turned to horizontal movement. At this point, the clasps 203 of the claw assembly 2 are detached from the bottle body assembly such that the cap is opened. Once opened, the bottle cap assembly is slightly popped upwards under the counteracting force of the sealing washer, which makes it more convenient to remove the bottle cap assembly.

Figure 7:
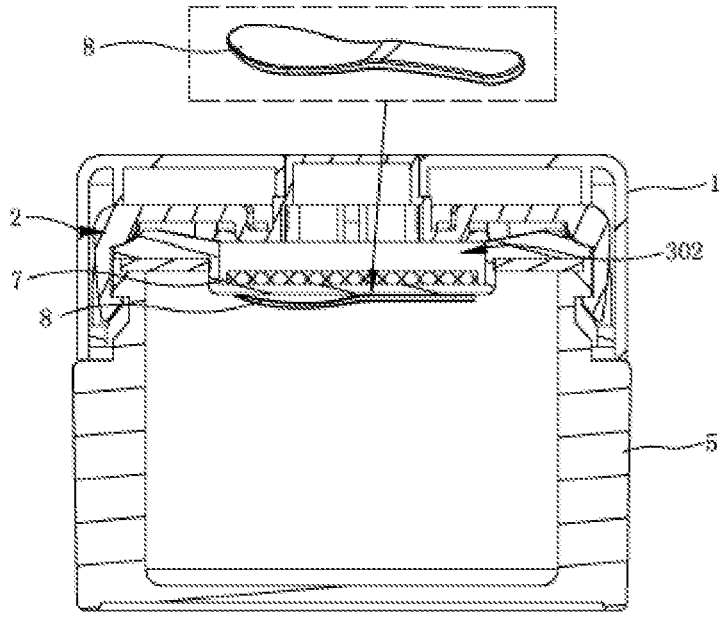
FIG. 7 is a schematic diagram of the cross-sectional structure of the second embodiment of the present invention, with the box in the figure being a 3D view of an iron scoop.
Figure 8:
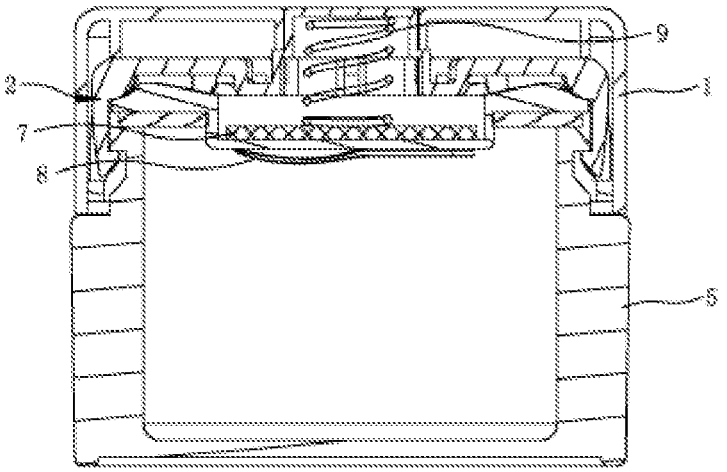
FIG. 8 is a schematic diagram of the modified structure of FIG. 7.

According to the above structural characteristics of Embodiment 1 and based on Embodiment 1, as referred to in Embodiment 2 of FIGS. 7 and 8, a magnet 7 is disposed on the bottom of the groove of the inner cap, an iron scoop 8 is disposed on the bottom of the claw assembly 2 on top of the bottle body of the bottle body assembly, and the iron scoop 8 is securely attached to the magnet inside the inner cap. A metal spring 9 is disposed inside the groove of the inner cap which further boosts the resilience property of the claw assembly 2.

To sum up, the cosmetic container can be opened by pressing the cap with one hand which eliminates the need of rotating or two-handed operation when opening or closing cap of the existing bottles available on the market, and enhances the perceived experience and is convenient. It is operated on the principle of resilience and leverage of plastic parts. The snap-fit structure of the claw assembly and the pressing operation structure from the top are considered as the primary technical characteristics of the cosmetic container, a LOGO is tailored for the area to press the claw assembly at the customer request, and this area may be round, polygonal, oval, star, heart-shaped, or have an irregular shape.

The invention claimed is:

1. A one-handed press-open cosmetic container comprising:

a bottle body assembly and a bottle cap assembly, wherein:

the bottle body assembly comprises:

a bottle body, a bottle neck connected to the bottle body, a snap ring at an outer diameter of the bottle neck at the bottle body, and a snap-fit groove at the outer diameter of the bottle neck underneath the snap ring;

the bottle cap assembly comprises:

an outer cap including a center hole extending through an uppermost surface of the outer cap, a claw assembly comprising (i) a plurality of clasps and (ii) a button column protruding upward from a top of the claw assembly, the button column extending from or being disposed in the center hole of the outer cap such that the button column is configured to be directly contacted by a user's finger, and an inner cap, the inner cap including a plurality of clasp holes;

the clasps and the top of the claw assembly are molded in one piece;

the clasps of the claw assembly are configured to pass through the clasp holes of the inner cap and snap-fit to the snap-fit groove of the bottle neck; and the claw assembly is configured to, upon receiving a downward force from the user's finger via the button column, deform the clasps outward to detach from the snap-fit groove of the bottle body.

2. A one-handed press-open cosmetic container according to claim 1, wherein:

each clasp of the claw assembly is provided with a curved humped inner rib at a joint between the clasp and the top of the claw assembly; and the inner cap includes a plurality of curved corners near upper ends of the clasp holes, the curved corners being positioned to respectively receive the curved humped inner ribs of the clasps.

3. A one-handed press-open cosmetic container according to claim 2, wherein the clasps of the claw assembly are arranged symmetrically in equally spaced pairs.

4. A one-handed press-open cosmetic container according to claim 1, wherein the top of the claw assembly includes an annular groove that surrounds the button column.

5. A one-handed press-open cosmetic container according to claim 1, wherein a top of the inner cap is provided with a downwardly humped groove, the bottle body assembly further comprises a sealing washer above the bottle neck, the groove of the inner cap is snapped into a center hole of the sealing washer, and the button column is disposed above the groove of the inner cap.

6. A one-handed press-open cosmetic container according to claim 5, wherein the groove of the inner cap is provided with a magnet, and an iron scoop is attached to the magnet inside the inner cap.

7. A one-handed press-open cosmetic container according to claim 5, further comprising a metal spring that exerts a force between (i) the groove of the inner cap and (ii) the button column.

8. A one-handed press-open cosmetic container according to claim 5, further comprising a spring that exerts a force between (i) the groove of the inner cap and (ii) the button column.

9. A one-handed press-open cosmetic container according to claim 8, wherein the spring is a metal spring.

10. A one-handed press-open cosmetic container according to claim 1, wherein the button column of the claw assembly is a button snapped into a center of the top of the claw assembly.

11. A one-handed press-open cosmetic container according to claim 1, wherein a top of the button column is provided with a mark, and the button column is round, polygonal, oval, star-shaped, heart-shaped, or has an irregular shape.

12. A one-handed press-open cosmetic container according to claim 1, wherein the button column of the claw assembly is molded in one piece with the clasps and the top of the claw assembly.

* * * * *